US005182830A

United States Patent [19]

Viola

[11] Patent Number: 5,182,830

[45] Date of Patent: Feb. 2, 1993

[54] TRUCK MOUNTED PAVEMENT SWEEPING BRUSH

[76] Inventor: John Viola, 77A Brookwood Dr., Rocky Hill, Conn. 06067

[21] Appl. No.: 799,422

[22] Filed: Nov. 26, 1991

[51] Int. Cl.[5] ..... E01H 1/02

[52] U.S. Cl. ..... 15/78; 15/160

[58] Field of Search ..... 15/78, 160, 210 R, 79.1, 15/81, 47, 50.2, 52.2, 54

[56] References Cited

U.S. PATENT DOCUMENTS

| | | | |
|---|---|---|---|
| 2,101,769 | 12/1937 | Westmoreland | 15/78 |
| 2,300,192 | 10/1942 | Allen | 15/78 |
| 2,855,618 | 10/1958 | Jones | 15/160 |
| 2,973,535 | 3/1961 | Olay | 15/78 |

FOREIGN PATENT DOCUMENTS

| | | | |
|---|---|---|---|
| 3630967 | 3/1988 | Fed. Rep. of Germany | 15/78 |

*Primary Examiner*—Edward L. Roberts

*Attorney, Agent, or Firm*—Robert S. Smith

[57] ABSTRACT

A brush assembly apparatus for cooperation with a snow plow mounting apparatus which includes apparatus for attachment to the associated snow plow mounting apparatus and an elongated main body. A plurality of bristles mounted in the main body extend generally downwardly during normal operation and apparatus is provided to bias the main body downwardly to insure thorough sweeping. In some form of the invention the apparatus also includes at least a first generally L-shaped axial extremity for the main body. Other forms of the invention may also include a second generally L-shaped axial extremity for the main body.

6 Claims, 1 Drawing Sheet

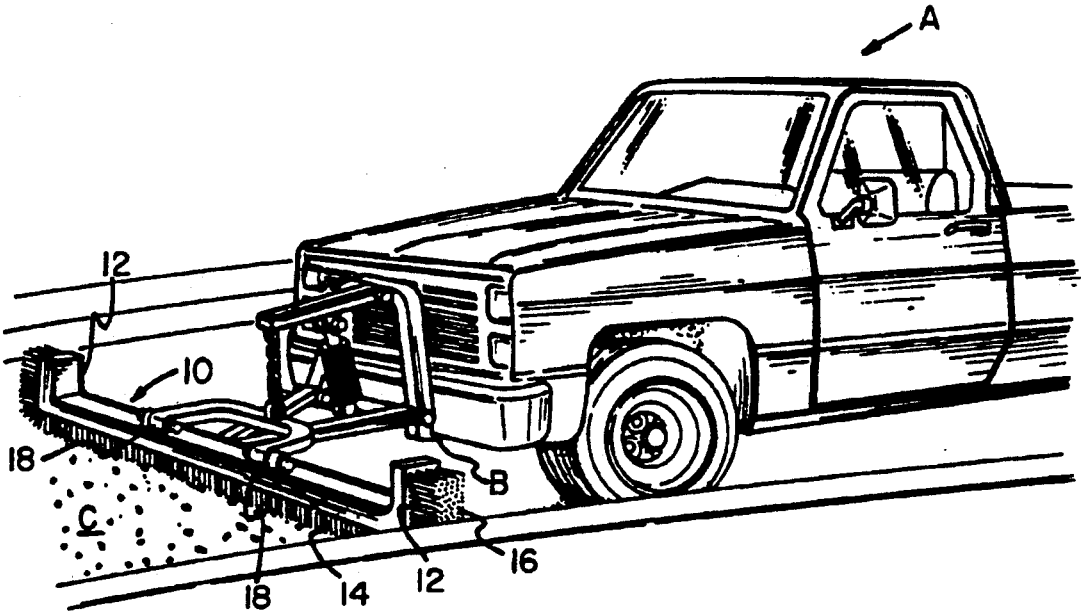
A
12
10
18
C
B
18
14
12
16

TRUCK MOUNTED PAVEMENT SWEEPING BRUSH

BACKGROUND OF THE INVENTION

The invention relates to apparatus for sweeping pavement and particularly to apparatus that can be retrofitted on existing snow plow positioning apparatus.

It is highly desirable to sweep streets, parking lots and the like. Various complicated and expensive apparatus using rotary brushes are know. This type of complex apparatus that often has a essentially a truck dedicated to the sweeping task. In other words the truck can not be used for carrying things or snow plowing or other tasks.

The prior art includes U.S. Pat. No. 4,346,928 that describes a brush mounted to touch the pavement just below the blade of a snowplow. The purpose is to sweep away light snow. That apparatus would not be practical for sweeping pavement in the summer time because it inherently is used simultaneously with the snow plow blade and this would clearly cause overheating of the truck engine. It will also be understood that if the blade is removed that the apparatus would not have enough weight to hold the brush down to accomplish thorough sweeping.

Other U.S. patents of general interest included U.S. Pat. Nos. 4,491,275; 4,835,811; 4,555,826; and 3,886,623.

It is an object of the invention to provide apparatus which will be easily be retrofitted on existing snow plow rigs and which permit easy and thorough sweeping of large areas such as parking lots.

It is an object of the invention to provide apparatus which is inexpensive to manufacture as well as requires a minimum of labor to install.

Still another oject of the invention is to provide a brush that can be used to sweep away light snow.

SUMMARY OF THE INVENTION

It has now been found that these and other objects of the invention may be attained in a brush assembly apparatus for cooperation with a snow plow mounting apparatus which includes means for attachment to the associated snow plow mounting apparatus and an elongated main body. A plurality of bristles mounted in the main body extend generally downwardly during normal operation and means are provided to bias the main body downwardly to insure thorough sweeping.

In some form of the invention the apparatus also includes at least a first generally L-shaped axial extremity for the main body. Other forms of the invention may also include a second generally L-shaped axial extremity for the main body.

The means biasing the main body downward may comprise a mass to bias the brush assembly.

BRIEF DESCRIPTION OF THE DRAWING

The invention will be better understood by reference to the accompanying drawing in which is a perspective view of a snow plow apparatus mounted on a truck carries the brush assembly in accordance with one form of the invention.

DESCRIPTION OF THE PREFERRED EMBODIMENT

Referring now to the drawing there is shown a truck A on which is carried a snow plow mounting apparatus B that is conventional. It will be understood that a conventional snow plow blade (not shown) may be attached to the mounting apparatus B in place of the brush assembly 10 that is shown.

The brush assembly 10 is elongated and has axial extremities 12 that are generally L-shaped. More particularly, the extremity may be disposed at a ninety degree angle ordinarily although other angles may be desirable for other applications. Ordinarily, the main body 14 will be weighted or have a weight sufficient to force the bristles 16 extending downwardly from the main body 14 against the pavement C.

It will be understood that the conventional snow plow blade is heavy and that the weight of the blade is sufficient to hold the blade against the pavement. Thus, the mounting apparatus B is not designed to provide a downward force. Accordingly, the brush assembly would be much to light to achieve thorough sweeping if additional weight was not provided. This additional weight may be added by merely increasing the size of the main body or by attaching auxiliary weights on the main body 14. Alternatively, weight may be added to the mounting apparatus B.

The axial extremities 12 of the brush assembly 10 are preferably L-shaped to enable the user to sweep the curb at the edge of a paved area. This feature of the apparatus in accordance with one form of the invention is shown in the drawing. Although the dimensions of the brush assembly may be chosen to contact the curb at both sides of a street it will be understood that the apparatus may be used to sweep much wider streets by moving from one side to the other.

The brush assembly 10 includes attachment means 18, 18 that corresponds to the means one the snow plow blade (not shown) that is taken off to accommodate the brush assembly 10.

In some forms of the invention other means for holding the brush assembly 10 down against the pavement may be provided such as hydraulic cylinders (not shown) instead of weights or merely a heavy main body 14.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the following claims.

Having thus described my invention I claim:

1. A brush assembly apparatus for cooperation with a snow plow mounting apparatus which comprises:

means for attachment to the associated snow plow mounting apparatus;

an elongated main body having at least a first generally L-shaped axial extremity;

a first plurality of bristles mounted in said main body and extending generally downwardly during normal operation and a second plurality of bristles mounted on said first axial extremity and extending outwardly in a generally axially aligned relationship to said main body; and said elongated main body including means biasing said main body downwardly to insure thorough sweeping.

2. The apparatus as described in claim 1 further including:

a second generally L-shaped axial extremity of said main body.

3. The apparatus as described in claim 2 further including:

a third plurality of bristles extending from said second generally L-shaped axial extremity.

4. The apparatus as described in claim 3 wherein:

said means biasing said main body downwardly comprises said main body being of sufficient mass to bias said brush assembly.

5. The apparatus as described in claim 2 wherein:

said means biasing said main body downwardly comprises said main body being of sufficient mass to bias said brush assembly.

6. The apparatus as described in claim 1 wherein:

said means biasing said main body downwardly comprises said main body being of sufficient mass to bias said brush assembly.

* * * * *